United States Patent [19]

Obata et al.

[11] Patent Number: 4,778,966

[45] Date of Patent: Oct. 18, 1988

[54] DEVICE FOR DISPLAYING OPERATION OF KNOB

[75] Inventors: Kosei Obata, Miyagi; Yasuo Takii; Minoru Oyama, both of Furukawa, all of Japan

[73] Assignee: Alps Electric Co., Ltd., Japan

[21] Appl. No.: 90,612

[22] Filed: Aug. 28, 1987

[30] Foreign Application Priority Data

Oct. 29, 1986 [JP] Japan ..... 61-164925[U]

[51] Int. Cl.[4] ..... H01H 9/16

[52] U.S. Cl. ..... 200/314; 200/310; 200/317

[58] Field of Search ..... 200/317, 312, 314, 310

[56] References Cited

U.S. PATENT DOCUMENTS 3,113,197 12/1963 Green ..... 200/317
3,267,926 8/1966 Prince ..... 200/317 X
4,385,221 5/1983 Dorfler ..... 200/314
4,549,050 10/1985 Lang ..... 200/312 X

*Primary Examiner*—Renee S. Luebke
*Attorney, Agent, or Firm*—Guy W. Shoup; Paul J. Winters

[57] ABSTRACT

There is disclosed a device for displaying the operation of a knob that is used for an automobile heater control unit, for example. The device has a frame in which a slider is mounted so as to be horizontally slidable. The knob is fixed to one end of the slider. A first light-conducting body that can be illuminated by a lamp to display the operation of the knob is so formed as to surround the slider and the knob. A second light-conducting body that can be illuminated by a second lamp to display the position of the knob is so mounted that the end of this body is located within the outer end surface of the knob. That is, the first light-conducting body is located around the second conducting body.

4 Claims, 2 Drawing Sheets

DEVICE FOR DISPLAYING OPERATION OF KNOB

FIELD OF THE INVENTION

The present invention relates to a device for displaying the operation of a knob installed on an automotive heater control unit, for example.

BACKGROUND OF THE INVENTION

A conventional display device of this kind is shown in FIGS. 3 and 4, where a slider 2 is mounted on a panel 1 so as to be horizontally movable. A knob 3 is put over the front end of the slider 2. A light-conducting body 4 for displaying the operation of the knob is received above the slider 2, and tapers off toward the knob 3. The knob 3 is provided with a hole 5 at a relatively high position. The light-conducting body 4 extends through the hole 5, and its front end is exposed to form an illuminator A for displaying the operation of the knob. Another light-conducting body 6 for displaying the position of the knob is received below the slider 2. The width of the body 6 is uniform as shown in FIG. 3. A face plate 9 is fitted in a hole 8 formed in the knob 3. The light-conducting body 6 extends outwardly of the panel 1, and the face plate 9 is attached to the outer end of the body 6 to form an illuminator B for displaying the position of the knob. Lamps 10 and 11 are mounted to display the operation and the position, respectively. A sliding switch 12 is provided to light up the lamp 10. An operated rod 13 is disposed opposite to the slider 2. The face plate 9 is marked with symbols 7 that indicate the operation.

The operation of the device for displaying the operation of the knob 3 is now described. The lamp 11 for indicating the position is lit up in the night or when the inside of the automobile is dark. The light emanating from the lamp 11 is projected into the light-conducting body 6 for displaying the position, so that the illuminator B lights up. As a result, the driver can see the position of the knob 3 through the face plate 9, even if the inside of the automobile is dark. Under this condition, the knob 3 is in its non-operative position.

In order to shift the knob 3 to its operative position, the knob is depressed as indicated by the arrow, i.e., moved to the left as viewed in FIG. 3. After the knob 3 comes to a halt at a given position, the slider 2 moves together with the knob 3. Then, the left end of the slider 2 pushes the rod 13 of the sliding switch 12, turning on this switch 12. This in turn lights up the lamp 10 for displaying the operation. The light emanating from the lamp 10 is projected into the light-conducting body 4, so that the illuminator A for displaying the operation lights up. As a result, the driver ascertains from outside of the panel 1 that the knob 3 is in its operative position.

When the knob 3 returns to its non-operative position, the rod 13 of the switch 12 returns to its original right position. Then, the light 10 and the illuminator A go out.

In the display device constructed as described above, both the illuminator B for displaying the position and the illuminator A for displaying the operation are installed on the knob 3. That is, both the position and the operation are displayed on the knob 3. Therefore, it is difficult to miniaturize the knob 3. Also, neither the illuminator A nor B can be made large, because they are installed in a limited area. Further, when the knob 3 is depressed to its operative position, the illuminator A for displaying the operation is hidden by the finger. This makes it difficult to ascertain that the operation is completed.

SUMMARY OF THE INVENTION

In view of the foregoing drawbacks with the prior art device, it is an object of the present invention to provide a device having a small knob and an illuminator which, when the knob is depressed, displays the operation of the knob without being hidden by the finger, whereby the operator can easily ascertain that the operation is completed.

The above object is achieved by a device for displaying the operation of a knob, said device comprising: a frame in which a slider is mounted so as to be movable along a straight line; a light-conducting body which is mounted inside the frame and around the side surfaces of both the slider and the knob that is fixed to one end of the slider, the light conducting body acting to display the operation of the knob; and a lamp which is mounted to the frame in such a way that the light-conducting body can be illuminated by the lamp, and which lights up according to the movement of the slider, the outer periphery of the knob being illuminated by the lamp.

In accordance with the invention, the illuminator for displaying the operation of the knob is located around the knob. Installed on the knob is only an illuminator for displaying the position of the knob. Therefore, the knob can be rendered smaller than the conventional knob. When the knob is depressed, the illuminator for displaying the operation is not hidden by the hand. Hence, it is easy for the operator to ascertain that the operation is completed.

DETAILED DESCRIPTION OF THE INVENTION

Figure 1:
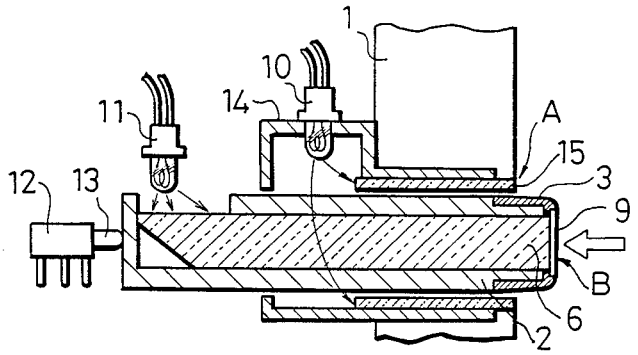
FIG. 1 is a cross-sectional view of main portions of a device that displays the operation of a knob, the device being fabricated in accordance with the invention.
Figure 2:
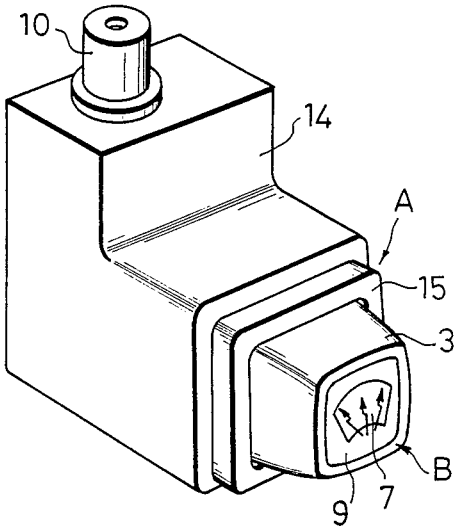
FIG. 2 is a perspective view of the device shown in FIG. 1, and in which the panel is omitted.
Figure 3:
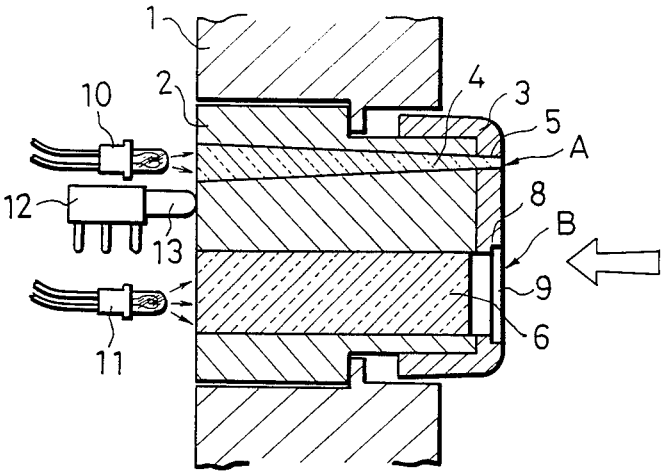
Fig. 3 PRIOR ART
FIG. 3 is a cross-sectional view of main portions of a conventional device that displays the operation of a knob.
Figure 4:
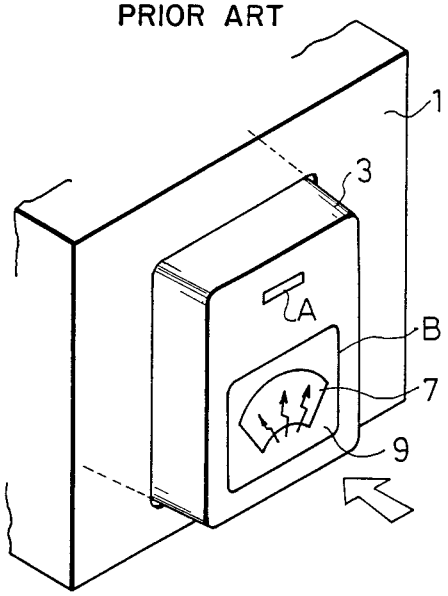
Fig. 4 PRIOR ART
FIG. 4 is a perspective view of the device shown in FIG. 3.

Referring to FIGS. 1 and 2, there is shown a display device embodying the concept of the invention. It is to be noted that like components are denoted by like reference numerals throughout all the figures. A frame 14 is fixed to a panel 1. A light-conducting body 15 that displays the operation of a knob 3 is mounted inside the frame 14 and around a slider 2 and the knob 3. The front end of the light-conducting body 15 is located outside the panel 1 and exposed to form an illuminator A for displaying the operation. A lamp 10 for displaying the operation is fixed to the frame 14 in such a way that the light-conducting body 15 is illuminated by the lamp 10. A light-conducting body 6 for displaying the position of the knob extends outwardly from the end of the slider 2. A lamp 11 for displaying the position is so disposed that the light-conducting body 6 can be illuminated by the lamp 11. The light-conducting body 6 extends outwardly of the panel 1 to form an illuminator B for displaying the position of the knob. A face plate 9 is mounted on the outer end of the light-conducting body 6.

The operation of the novel device constructed as described above is now described. In the night or when the inside of the automobile is dark, the lamp 11 for displaying the position is lit up. The light emitted by the lamp 11 is projected into the light-conducting body 6 and then transmitted to the illuminator B for displaying the position through the face plate 9. Therefore, the driver can ascertain the position of the knob 3.

In order to shift the knob 3 to its operative position, it is pushed in the direction indicated by the arrow shown in FIG. 1, i.e., moved to the left. After the knob 3 comes to a halt at a given position, the slider 2 moves together with the knob. The left end of the slider 2 pushes the operated rod 13 of the sliding switch 12 to the left, turning on the lamp 10 that displays the operation of the knob. The light emitted by the lamp 10 enters the light-conducting body 15, lighting up the illuminator A. Under this condition, the driver can ascertain from outside the panel 1 that the knob 3 is in its operative position.

When the knob 3 returns to its original non-operative position, the rod 13 of the switch 12 returns to its original right position. Then, the lamp 10 and the illuminator A go out.

The device which displays the operation of the knob 3 has the structure described above. The illuminator A for displaying the operation of the knob 3 is located around the knob 3. Installed on the knob 3 is only the illuminator B for displaying the position. Therefore, the knob 3 can be made smaller than the conventional knob. Also, when the knob 3 is depressed, the illuminator A that displays the operation of the knob is not hidden by the finger. Hence, the driver can easily ascertain that the operation is completed. In addition, the light rays which are emitted from the lamps 10 and 11 do not interfere with each other, because the lamps 10 and 11 are isolated from each other by the frame 14.

In accordance with the invention, an illuminator for displaying the operation of a knob is located around the knob. Installed on the knob is only an illuminator for displaying the position. This permits the knob to be fabricated in smaller size than conventional. At the same time, the illuminator for displaying the operation can be made larger than conventional. When the knob is depressed, the illuminator for displaying the operation is not hidden by the finger and so it is easy for the driver to ascertain that the operation has finished.

What is claimed is:

1. A display device for displaying the operation of a knob comprising:

a mounting panel having an opening in a longitudinal direction therethrough;

a frame configured in the shape of and mounted in said opening in said panel and including a first light conducting body configured in the shape of said opening and having a peripheral illuminator edge extending to an external side of said panel, wherein said first light conducting body defines a passage in the longitudinal direction therethrough;

a slider slidably mounted in said passage of said first light conducting body, said slider including a second light conducting body elongated in the longitudinal direction and a knob at a front end of the second light conducting body which projects on the external side of said panel, said slider being slidable longitudinally between an OFF position when the knob is not pushed and an ON position when the knob is pushed in the longitudinal direction;

a first lamp mounted in a hollow portion of said frame on an internal side of said panel spaced from said slider in a direction transverse to the longitudinal direction and adjacent an internal portion of said first light conducting body for illuminating said first light conducting body;

a second lamp mounted on the internal side of said panel spaced from said slider in a direction transverse to the longitudinal direction adjacent a rear end of said second light conducting body for illuminating said second light conducting body; and an internal switch situated on the internal side of said panel facing and being contactable by said rear end of said slider which turns said firt lamp ON and OFF in conjunction with movement of said slider between said ON and OFF positions.

2. A display device according to claim 1 wherein said frame is formed so as to prevent light from the first lamp from illuminating the second light conducting body and preventing light from the second lamp from illuminating the first light conducting body.

3. A display device in accordance with claim 1 wherein an external illuminator edge of said first light conducting body surrounds said knob such that it remains visible even when a user is operating said knob.

4. A display device according to claim 1 wherein the second lamp is ON continuously, thus serving to indicate the location of the knob under conditions of low ambient illumination.

* * * * *

UNITED STATES PATENT AND TRADEMARK OFFICE

CERTIFICATE OF CORRECTION

PATENT NO. : 4,778,966

DATED : October 18, 1988

INVENTOR(S) : Kosei Obata et al.

It is certified that error appears in the above-identified patent and that said Letters Patent is hereby corrected as shown below:

Col. 4, line 35, "firt" should read --first--.

Signed and Sealed this

Eighteenth Day of April, 1989

*Attest:*

DONALD J. QUIGG

*Attesting Officer*

*Commissioner of Patents and Trademarks*